United States Patent [19]

Ullmann et al.

[11] Patent Number: 4,604,801

[45] Date of Patent: Aug. 12, 1986

[54] SHAVER WITH INSERTABLE AUXILIARY FRAME

[75] Inventors: Roland Ullmann, Offenbach; Hans E. Heintke, Wächtersbach, both of Fed. Rep. of Germany

[73] Assignee: Braun Aktiengesellschaft, Kronberg, Fed. Rep. of Germany

[21] Appl. No.: 724,127

[22] Filed: Apr. 17, 1985

[30] Foreign Application Priority Data

Apr. 21, 1984 [DE] Fed. Rep. of Germany ..... 3415122

[51] Int. Cl.[4] ..... B26B 19/38

[52] U.S. Cl. ..... 30/43.92; 30/45

[58] Field of Search ..... 30/43, 43.1, 43.6, 43.9, 30/43.92, 43.7, 43.8, 43.91, 45, 44, 42

[56] References Cited

U.S. PATENT DOCUMENTS

| | | | |
|---|---|---|---|
| 2,246,586 | 6/1941 | Hanley | 30/43.92 |
| 2,318,351 | 5/1943 | Alexay | 30/42 X |
| 2,561,241 | 7/1951 | Streng | 30/43.92 |
| 2,661,531 | 12/1953 | Streng | 30/43.92 X |
| 2,734,266 | 2/1956 | Schreyer | 30/43.1 X |
| 3,105,298 | 10/1963 | Carissimi | 30/43.92 |
| 3,191,299 | 6/1965 | Locke | 30/43.92 |
| 3,365,796 | 1/1968 | Tolmie et al. | 30/43.92 |
| 3,967,374 | 7/1976 | Boiten | 30/43.92 |
| 3,999,291 | 12/1976 | Boer | 30/43.92 |
| 4,428,117 | 1/1984 | Horii et al. | 30/43.7 X |

FOREIGN PATENT DOCUMENTS 2857468 7/1980 Fed. Rep. of Germany .

*Primary Examiner*—Jimmy C. Peters

*Attorney, Agent, or Firm*—Raymond J. De Vellis

[57] ABSTRACT

Dry shaver with an auxiliary frame displaceably insertable in the direction of the lower cutter, said frame being retained via spring-tensioned locking means in the end cheeks of a shaver housing or of a cutting head frame, and unlocked and removed in the removal direction by unlocking buttons, which act on the up ramps provided on the locking means.

7 Claims, 4 Drawing Figures

2
32
34
33
24
30
31
8
29
28
27
17
25
15
26
14
18
21
22
10
9
19
7
7
7
13
4
19
20
7

SHAVER WITH INSERTABLE AUXILIARY FRAME

BACKGROUND OF THE INVENTION

The invention relates to a dry shaver with a movable lower cutter and an upper cutter cooperating with the lower cutter, said upper cutter being tensioned in an auxiliary frame provided at its ends with spring-tensioned locking means.

Japanese Utility Model No. 53-40306 teaches a cutting head frame with an auxiliary frame, which is inserted from the housing side of the shaver into the cutting head frame and is retained in the end cheeks of the cutting head frame by means of spring-tensioned locking arms disposed pairwise in the ends, said locking arms engaging correspondingly designed recesses in the end cheeks of the cutting head frame. To remove the auxiliary frame from the cutting head frame, it is necessary to reach into the narrow cutting head frame and exert considerable tensile forces to release the auxiliary frame from its engagement. This is not only inconvenient, but also involves the danger of damaging the auxiliary frame, especially its cutting foil.

German Pat. No. 28 57 468 teaches a cutting head frame with an auxiliary frame insertable from the housing side of the shaver, said auxiliary frame being provided with a flange on which the cutting head frame rests and on which a spring-tensioned locking arm and a holding plate associated therewith are formed in the vicinity of the ends of the auxiliary frame. In this design, the auxiliary frame can be pulled out of the cutting head frame over the holding plates by engaging it from outside. To overcome the locking action, however, considerable tensile forces are required for this device. Because of the cutting head frame resting on the flange of the auxiliary frame, the size of the auxiliary frame is a function of that of the cutting head frame. As a result of the fastening of the cutting head frame to the shaver housing, the cutting head frame and auxiliary frame acquire a relatively high height dimension and width dimension. The resultant material expenditure for the auxiliary frame with cutting foil has an unfavorable effect on its manufacturing costs.

SUMMARY OF THE INVENTION

Taking its departure from this state of the art, the goal of the invention is to provide a dry shaver, wherein the auxiliary frame is easily insertable and removable, whereby in particular the tensile force for removing the auxiliary frame is considerably reduced, said frame being retained in a specific manner in the locking position in the removal direction and whose size is reduced to a minimum.

This goal is achieved according to the invention by virtue of the fact that the auxiliary frame is displaceably insertable between the end cheeks of a cutting head frame or a shaver housing in the direction of the lower cutter, by the fact that spring-tensioned locking means with up ramps are provided on the ends of the auxiliary frame, by the fact that spring-tensioned unlocking buttons are disposed in the end cheeks, said buttons being capable of actuating the locking means via the up ramps, and by the fact that a recess with a stop for the locking means of the auxiliary frame is provided in each of the end cheeks above the unlocking buttons.

The especially easy removability of the auxiliary frame disposed between the end cheeks of a cutting head frame or a shaver housing provided with end cheeks is accomplished by providing spring-tensioned unlocking buttons in the end cheeks, said buttons acting on up ramps during the unlocking process, said ramps being provided on the spring-tensioned locking means located on the ends of the auxiliary frame, whereby the slopes of the up ramps are so designed that the pressure exerted on the unlocking buttons slides them, and therefore the auxiliary frame, out of the locking area.

The released auxiliary frame is then simply removed by the user from the end cheeks.

When the auxiliary frame is in the locked position, the lower cutter abuts the upper cutter tensioned in the auxiliary frame by spring action. Utilizing this spring tension acting in the removal direction additionally favors the removability of the auxiliary frame after unlocking and also ensures that the locked auxiliary frame firmly abuts the groove walls of recesses provided in the end cheeks in the removal direction via the spring-tensioned locking means.

The insertability of the auxiliary frame between the end cheeks of a cutting head frame or of a shaver housing from the exterior in the direction of the lower cutter permits a considerable reduction in the dimensions of the auxiliary frame since the frame of the auxiliary frame which supports the upper cutter can already be provided at the level of the lower cutter edge area.

The recesses for the spring-tensioned locking means of the auxiliary frame are provided on the inside of each end cheek of a cutting head frame or a shaver housing which is correspondingly designed, and consist of a groove running lengthwise whose groove wall, abutting the end of the end check, forms a stop for the auxiliary frame above the corresponding locking means.

Handling when sliding on or removing the auxiliary frame is additionally facilitated by guide grooves provided in the end cheeks and running lengthwise.

Advantageously, the upper cutter is tensioned convexly in the auxiliary frame, whereby the ends of the auxiliary frame penetrate relatively far into the convexity of the upper cutter with the locking means provided.

According to a preferred embodiment, provision is made for the spring-tensioned locking means to be made nose-shaped and to have their nose ends directed toward the upper cutter projecting beyond the ends of the auxiliary frame.

The up ramps of the locking means are formed in simple fashion by the backs of the noses running diagonally from the projecting nose ends to the rearward ends of the auxiliary frame.

Preferably, two rigid guide rails are provided on each of the ends of the auxiliary frame, which engage a correspondingly designed guide groove in the end cheeks.

According to a preferred embodiment of the invention, the spring-tensioned locking means located in each end of the auxiliary frame are provided between the two rigid guide rails.

BRIEF DESCRIPTION OF THE DRAWINGS

Further advantages and details of the invention will be apparent from the description which follows and the drawing, in which preferred embodiments are shown.

DESCRIPTION OF THE PREFERRED EMBODIMENT

Figure 1:
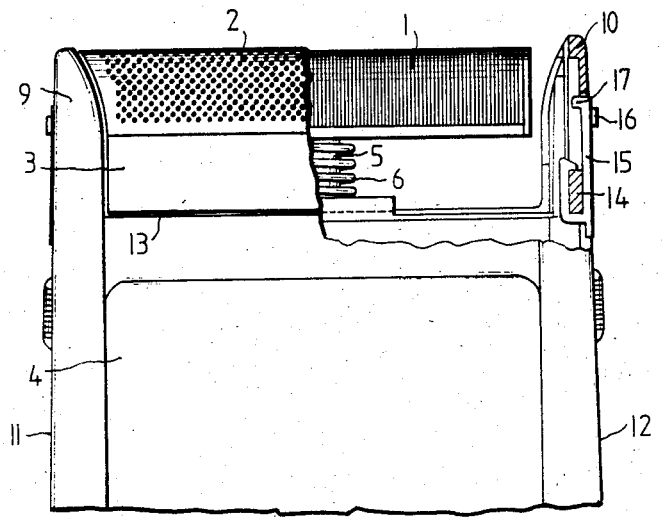
FIG. 1 shows the cutting area of a dry shaver in a front view with a partial cross section.

FIG. 1 shows the cutting area of a dry shaver with a movable lower cutter 1, an upper cutter 2 cooperating with the lower cutter, said upper cutter being tensioned convexly in an auxiliary frame 3. Lower cutter 1 is given a reciprocating motion by a motor, not shown, located in housing 4 of the dry shaver, via a swing lever 5. A coil spring 6 presses lower cutter 1 in known fashion against upper cutter 2.

End cheeks 9 and 10 in the embodiment shown in FIG. 1 are part of housing 4. As extensions of housing ends 11 and 12 they are formed on the upper housing wall 13 of housing 4 located beneath lower cutter 1. Auxiliary frame 3, insertable in the direction of housing 4 as well as end cheek 10, are shown in partial section and show the auxiliary frame 3 located between end cheeks 9 and 10 in the locked position.

The partial section made through end cheek 10 shows unlocking button 15 fastened by a clip connection to a cross member 14 in end cheek 10, with a projection 16 projecting out of the contour of the end cheek and a projection 17 facing lower cutter 1. Further parts and measures which serve for unlocking and locking auxiliary frame 3 as well as their function will be described in greater detail with reference to FIGS. 2, 3, and 4.

Figure 2:
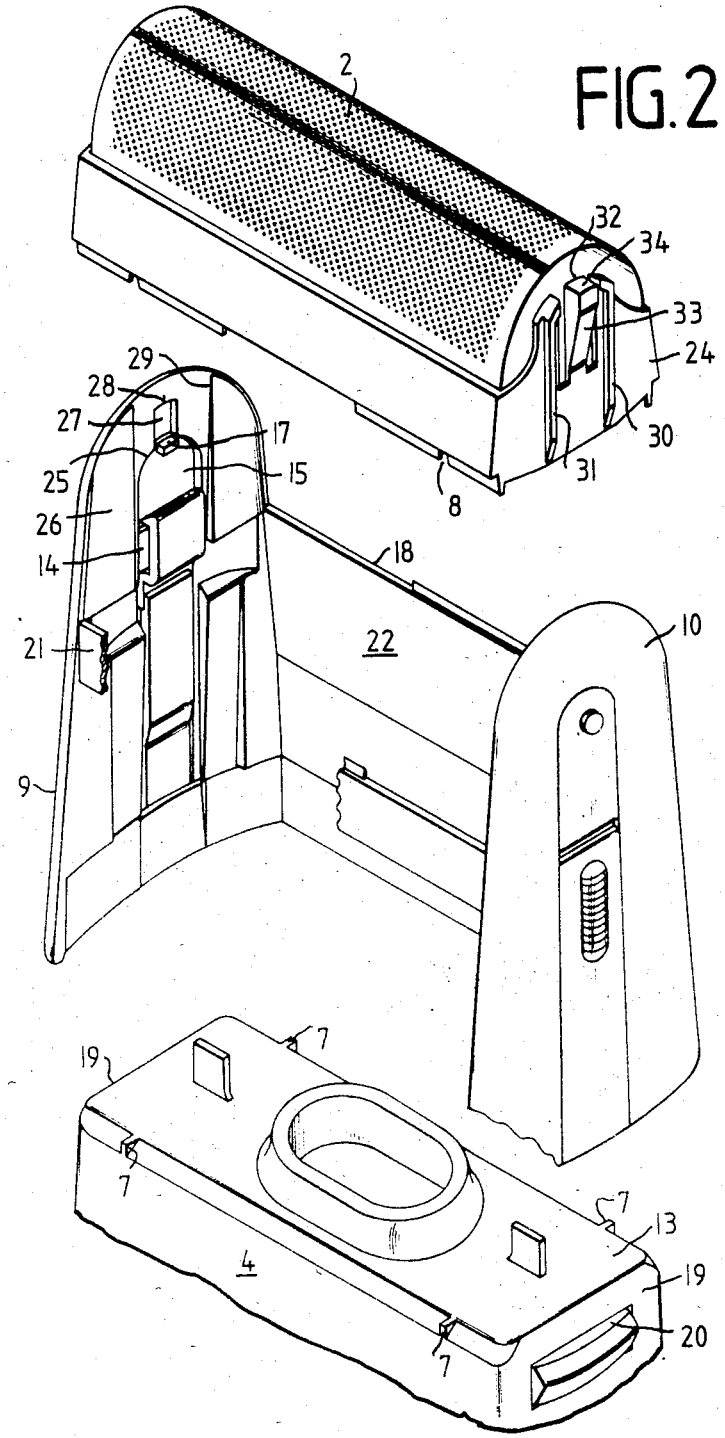
FIG. 2 is an exploded view of the auxiliary frame, cutting head frame, and the upper part of a shaver housing in perspective.

According to the embodiment shown in FIG. 2, in contrast to FIG. 1, a cutting head frame 18 slidable on housing 4 is provided, between whose end cheeks 9 and 10 auxiliary frame 3 is insertable in the housing direction.

Locking elements 20, located on both ends 19 and tensioned by compression springs, serve to lock cutting head frame 18 to the housing. To center auxiliary frame 3 on housing 4, projections 7 are formed on the housing, said projections engaging corresponding cutouts 8 in auxiliary frame 3.

When cutting head frame 18 is in the locked position with the housing, front wall 21 and rear wall 22 of the cutting head frame terminate approximately at the level of housing wall 13 of housing 4. End cheeks 9 and 10 which receive and hold auxiliary frame 3 then project opposite housing wall 13, so that this state is comparable with that shown and described in FIG. 1. The two ends 23 and 24 of auxiliary frame 3 are designed identically. The same is true of the two end cheeks 9 and 10.

An opening 25 running lengthwise of the end cheek is provided in end cheek 9, in which opening a cross member 14 which runs transversely across the opening is formed. An unlocking button 15 movable in a spring-tensioned fashion is fastened to cross member 14, e.g. by means of a clip connection. An inwardly directed projection 17 is formed on the end of unlocking button 15 which faces the end of the end cheek. A groove 27 running lengthwise is provided above projection 17 on the inside 26 of end cheek 9, whose groove wall 28 lying in the removal direction of auxiliary frame 3 serves as a stop for the locked locking means.

To facilitate insertion and removal of auxiliary frame 3, guide rails 30, 31 are formed on ends 23, 24 of the auxiliary frame, running lengthwise, said rails engaging a guide groove 29 provided in end cheek 9 and guided by its side walls. Opening 25 and groove 27 are located in the rear wall of this guide groove 29, lower down. Upper cutter 2 is tensioned convexly in auxiliary frame 3. Ends 23 and 24 of the auxiliary frame have a contour that matches the convexity and, being so designed, project relatively far into the convexity of the upper cutter. Guide rails 30 and 31 are formed on end 24. A spring-tensioned locking means 32 with an up ramp 33 is provided between these two guide rails. Locking means 32 is designed to be nose-shaped, the back of said nose, becoming effective as an up ramp 33, being directed outward and away from end 24 and rising in the removal direction. Wall 34 which forms the return of the back of the nose to end 24 serves as a stop for auxiliary frame 3 in groove wall 28 in groove 27 in end cheek 10.

When auxiliry frame 3 is inserted between end cheeks 9 and 10 as shown in FIGS. 1 or 2, guide rails 30 and 31 engage guide grooves 29 provided in the end cheeks. In the course of this insertion process, up ramps 33 of locking means 32, which project out from ends 23 and 24 of the auxiliary frame, abut end cheeks 9 and 10. As a result of the spring-tensioned characteristics of locking means 32, the latter are pushed into auxiliary frame 3 via and in accordance with the slope of up ramps 33. After passing the ends of the end cheeks, the rear wall of guide groove 29 provides additional guidance until locking means 32 snap into grooves 27. Shortly before locking means 32 snap into grooves 27, auxiliary frame 3 entrains lower cutter 1 above upper cutter 2 in the insertion direction against the pressure of coil spring 6, so that after locking means 32 snap into grooves 27, coil spring 6 which is under pressure acts via lower cutter 1 and upper cutter 2 on auxiliary frame 3, and brings the walls 34 of locking means 32 located in grooves 27 into contact with groove walls 28. In this position, auxiliary frame 3 is held in a specific position between end cheeks 9 and 10 and is firmly locked thereto.

The removal of an auxiliary frame 3 locked by end cheeks 9 and 10 of a shaver housing 4 or cutting head frame 18 is described in greater detail with reference to FIGS. 3 and 4.

Figure 3:
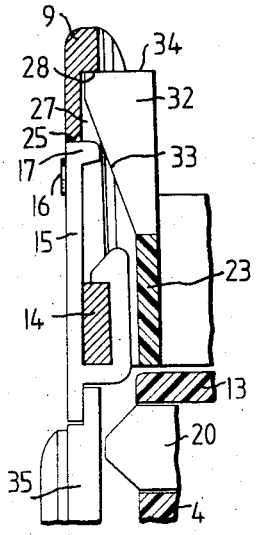
FIG. 3 is a lengthwise section through one of the two identically designed end cheeks of a shaver housing or a cutting head frame with a partial section through one of the two identically designed ends of an auxiliary frame in the locked position.
Figure 4:
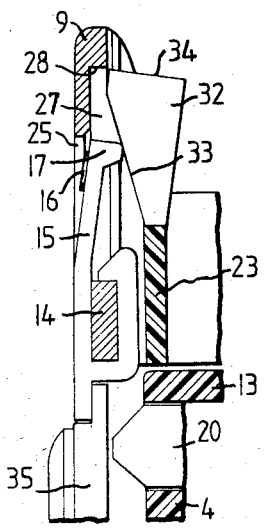
FIG. 4 is a lengthwise section and partial section according to FIG. 3 with one of the locking means engaged by an unlocking button.

The cutaway views in FIGS. 3 and 4 show as an example the locking area of auxiliary frame 3 with end cheek 9 of a cutting head frame 18 locked to housing 4 whose locking elements 20 and 35 related thereto are not important.

In end cheek 9, spring-tensioned locking means 32 are in groove 27, whereby wall 34 abuts groove wall 28. Down ramp 33 leads out of groove 27 in the direction of housing wall 13 of housing 4 toward the recessed end 23 of auxiliary frame 3.

In end cheek 9 an opening 25, running lengthwise, is provided with a cross member 14, to which an unlocking button 15 made of springy material is fastened, e.g. by means of a clip connection. Cross member 14 can, however, also be mounted rotatably in order to permit a swiveling motion of unlocking button 15. From cross member 14, unlocking button 15 runs inside opening 25 in the direction of the end cheek end and terminates in a projection 17 directed toward auxiliary frame 3 in the upper area of up ramp 33 of locking means 32.

By actuating unlocking button 15 via projection 16, the latter abuts or rotates around cross member 14 inward, forcing the spring-tensioned locking means 32 via down ramp 33 into auxiliary frame 3, whereby, as can be seen from FIG. 4, locking means 32 are moved out of groove 27 and therefore out of the locking position. By continued deflection of unlocking button 15, the unlocked locking means 32 and hence auxiliary frame 3 with its down ramp 33 slide off the projection and lift off housing wall 13, or move out of end cheeks 9 and 10. The released auxiliary frame 18 is then simply lifted off end cheeks 9 and 10 by the user. This process is initially supported and facilitated by the fact that in the locked state of auxiliary frame 3, the application pressure of lower cutter 1 which abuts upper cutter 2 under the action of coil spring 6 is additionally employed. End cheek 10 as well as end 24 of auxiliary frame 3 are designed analogously to the description above.

While an embodiment and application of this invention have been shown and described, it will be apparent that any more modifications are possible without departing from the inventive concepts herein described. The invention, therefore, is not to be restricted except as is necessary by the prior art and by the spirit of the appended claims.

What is claimed as new and desired to be secured by Letters Patent of the United States is:

1. A dry shaver comprising:

a shaver housing including first and second end cheeks;

an elongated interchangeable frame member being displaceably insertable between said first and second end cheeks of said shaver housing, and having ends spaced from one another in the direction of elongation, said interchangeable frame member having first and second substantially parallel longitudinal sides connecting said ends, thereby defining an opening, said ends including means for releasably mounting said interchangeable frame member to said first and second end cheeks of said shaver housing;

means for tensioning and attaching a shaving foil to said interchangeable frame member opposite said opening of said interchangeable frame member;

a reciprocating elongated inner cutting head cooperating with the shaving foil, said inner cutting head being positioned between said first and said second end cheeks of said shaver housing and between said ends of said interchangeable frame member through said opening of said interchangeable frame member; and said means for releasably mounting said interchangeable frame member includes, on each end of said interchangeable frame member, spring-tensioned locking means having an up ramp, each of said up ramps terminating in a free end, said first and second end cheeks each including an aperture and a spring-tensioned button member disposed in said aperture, each of said button members being displaceable toward one of said ends of said interchangeable frame member, each of said end cheeks also including a recess and a stop member for cooperating with said spring-tensioned locking means, whereby movement of said opening of said interchangeable frame member in the direction of said inner cutting head and between said first and second end cheeks causes inner displacement of said up ramps until said free ends of said up ramps cooperate with said recesses and stop members on said end cheeks of said shaver housing to lock said interchangeable frame member to said shaver housing, and whereby the displacement of said buttons causes the displacement of said up ramps thereby removing said free ends of each of said up ramps from said end cheeks of said shaver housing and unlocking said interchangeable frame member from said shaver housing.

2. The dry shaver as in claim 1 wherein said shaver housing includes a removable shaving head frame releasably mounted on said shaver housing, said removable shaving head frame including said first and second end cheeks.

3. The dry shaver as in claim 1 wherein each of said recesses in said first and said second end cheeks consists of a groove and each of said stop members consists of an upper end wall of said groove.

4. The dry shaver as in claim 1 wherein said first and said second end cheeks each include a guide groove for guiding said interchangeable frame member.

5. The dry shaver as in claim 1 wherein the shaving foil is convexly tensioned in said interchangeable frame member where said ends of said interchangeable frame member, including said means for releasably mounting said interchangeable frame member, project into said convexity to a postion proximate the shaving foil.

6. The dry shaver as in claim 1 wherein said free end of each of said up ramps has a nose shape.

7. In a dry shaver having a reciprocating elongated inner cutter and a housing, an elongated interchangeable frame member comprising:

ends spaced from one another in the direction of elongation, said interchangeable frame member having first and second substantially parallel longitudinal sides connecting said ends, said ends including means for releasably mounting said interchangeable frame member to the dry shaver housing, said interchangeable frame member being displaceably insertable in the housing of the dry shaver and over the reciprocating elongated inner cutter;

means for tensioning and attaching a shaving foil to said interchangeable frame member for cooperation with the reciprocating elongated inner cutter; and said means for releasably mounting said interchangeable frame member including, on each end of said interchangeable frame member, spring-tensioned locking means having an up ramp, each of said up ramps terminating in a free end, said spring-tensioned locking means cooperating with the housing of the dry shaver whereby assembly of said interchangeable frame member in the direction of said inner cutter causes the inner displacement of said up ramps until said free ends of said up ramps cooperate with the housing of the dry shaver to lock said interchangeable frame member to said dry shaver housing, and whereby said interchangeable frame member is removable from cooperation with the housing of the dry shaver when said free end of said each of said up ramps is displaced out of cooperation with the housing of the dry shaver.

* * * * *